US005357691A

United States Patent [19]

Hyde et al.

[11] Patent Number: 5,357,691

[45] Date of Patent: Oct. 25, 1994

[54] EASILY FASTENED SHOE

[75] Inventors: Paula Hyde, Newton; Jennifer May, Brookline, both of Mass.

[73] Assignee: The Keds Corporation, Cambridge, Mass.

[21] Appl. No.: 196,903

[22] Filed: Feb. 15, 1994

Related U.S. Application Data

[63] Continuation of Ser. No. 59,111, May 7, 1993, abandoned.

[51] Int. Cl.[5] ..... A43B 23/26; A43B 11/00

[52] U.S. Cl. ..... 36/54; 36/50.1

[58] Field of Search ..... 36/50.1, 54, 133

[56] References Cited

U.S. PATENT DOCUMENTS

| | | | |
|---|---|---|---|
| 205,129 | 6/1878 | Packard | 36/54 X |
| 1,253,496 | 1/1918 | Kaiser | 36/54 |
| 2,654,965 | 10/1953 | Sloan et al. | 36/54 X |
| 3,279,015 | 10/1966 | Henning | 36/50.1 X |
| 4,081,916 | 4/1978 | Salisbury | 36/50.1 |
| 4,308,672 | 1/1982 | Antonious | 36/50.1 |
| 4,414,761 | 11/1983 | Mahood | 36/50.1 |
| 4,628,622 | 12/1986 | McBarron | 36/50.1 |

*Primary Examiner*—Paul T. Sewell
*Assistant Examiner*—Ted Kavanaugh
*Attorney, Agent, or Firm*—Fish & Richardson

[57] ABSTRACT

A shoe has a tongue and a fastener assembly which are moveable out of the way of the wearer's foot to leave a large opening in the shoe upper, and to stay out of the way until moved back.

8 Claims, 2 Drawing Sheets

EASILY FASTENED SHOE

This application is a continuation of application Ser. No. 08/059,111, filed May 7, 1993, now abandoned.

BACKGROUND OF THE INVENTION

The present invention relates to shoes.

Shoes which are fastened with laces enjoy widespread popularity. Most athletic shoes and many men's, children's and casual women's shoes are fastened in this manner.

Laces allow the width of the shoe to be adjustable, to provide comfort and allow different types of socks to be worn with the shoe. However, laces may prove difficult or time-consuming to tie, particularly for children. Lace-up shoes may also be difficult to get onto the wearer's foot, especially when one is in a rush for time, requiring loosening of the laces and maneuvering of the tongue. Lace-up shoes can thus be extremely difficult for smaller children to put on, even with assistance.

To address these disadvantages, some casual and athletic shoes have straps provided with hook and loop (VELCRO TM) fasteners instead of laces. This type of shoe alleviates some of the above problems, but still can be difficult to put on, particularly for a small child.

SUMMARY OF THE INVENTION

The present invention features an improved shoe which is easily placed on the foot and fastened. The preferred shoe includes a tongue and a fastener assembly which are both adapted to be moved out of the way of the wearer's foot, leaving a large opening in the shoe upper, and both are further adapted to stay out of the way until affirmatively moved back into place. The shoe can thus be easily and quickly put on, and it is particularly well adapted for use with, and by, smaller children. The shoe upper may also be provided with laces, in addition to the fastener assembly, which may be used to adjust shoe size, to teach children to tie laces, or merely for decoration.

The invention features a shoe which includes a sole and an upper mounted on the sole, the upper having a vamp. The vamp includes a pair of side quarters which define a foot-receiving opening therebetween, a fastener assembly which extends across the opening to join the two side quarters, a toe portion which is forward of the opening and a tongue. The tongue, when the shoe is worn, extends across the opening, between the side quarters (its normal position).

In one aspect, the tongue is moveable to a second position, in which it is clear of the opening, the tongue being sized to be held in the second position by the side quarters until it is affirmatively moved back toward the normal position.

In another aspect, the fastener assembly comprises a first fastening portion disposed on one of the side quarters, and a second fastening portion associated with the other side quarter. The second fastening portion is adapted to be movable between a first position, in which it extends across the opening defined by the side quarters and engages the first fastening portion, fastening the shoe, and a second position, in which it is clear of the opening. The second fastening portion is adapted to remain in the second position until it is affirmatively moved toward the first position.

In preferred embodiments, the shoe includes both of the above features. Preferably, the tongue, in a region adjacent the toe portion, defines an "hourglass" shape, i.e., there is a notch on either side of the tongue, most preferably a substantially U-shaped notch. The notches are engaged by the side sections when the tongue is in its second position, causing the tongue to remain in the second position until moved.

In other preferred embodiments, the first fastening portion includes a first set of eyelets for receiving a shoelace, the associated side quarter includes corresponding, opposed second set of eyelets, and the first fastening portion is detachably mounted on the associated side quarter, with a shoelace threaded through the opposed sets of eyelets. Preferably the fastener assembly includes cooperating hook and loop fasteners on the first and second fastening portions.

Other features and advantages of the invention will be apparent to those skilled in the art from the following detailed description of a presently preferred embodiment, and from the claims.

DESCRIPTION OF THE PREFERRED EMBODIMENTS

Figure 1:
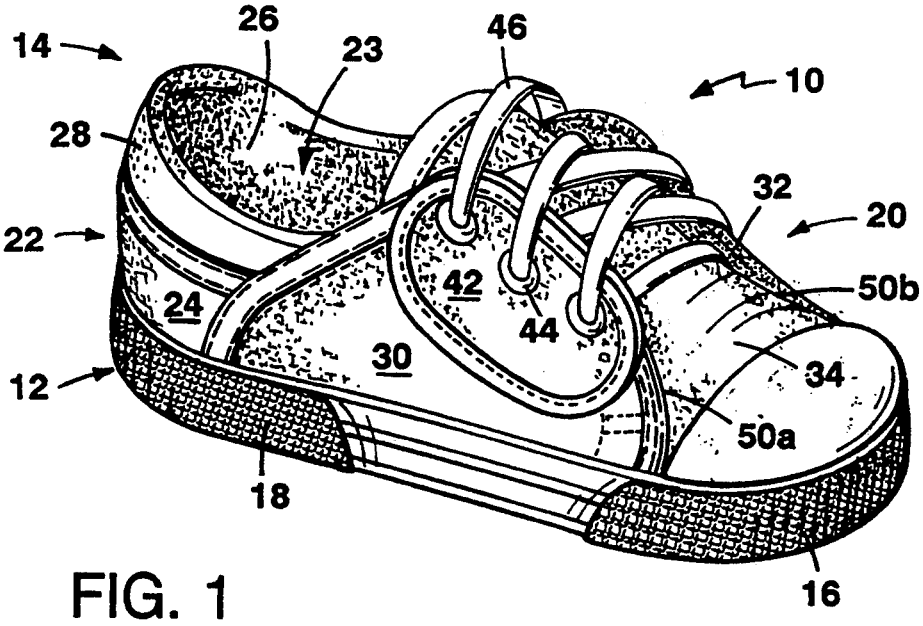
FIG. 1 is a perspective view of a shoe according to one embodiment of the invention, in a fastened condition.

A preferred shoe 10 according to the invention is shown in FIGS. 1–4 Shoe 10 is a child's "sneaker" canvas athletic shoe, which includes sole 12, and upper 14 which is mounted on the sole in a conventional manner.

Preferably sole 12 is of a conventional construction, including an outsole, midsole and insole (not shown), as is well known in the shoe art. To improve durability, sole 12 preferably includes toe cap 16 and heel cap 18.

Upper 14 is preferably canvas or leather, but may be formed of any other suitable material. Upper 14 has a vamp 20 and quarters 22, which define an opening 23. Quarters 22 may include a semirigid counter (not shown) disposed between foxing 24 and lining 26, and a padded collar 28 around the top edge of the upper. Vamp 20 includes a pair of side quarters 30, 32, a toe portion 34 and a tongue 36. Side quarters 30, 32 and toe portion 34 together define a forefoot opening 25.

Figure 2:
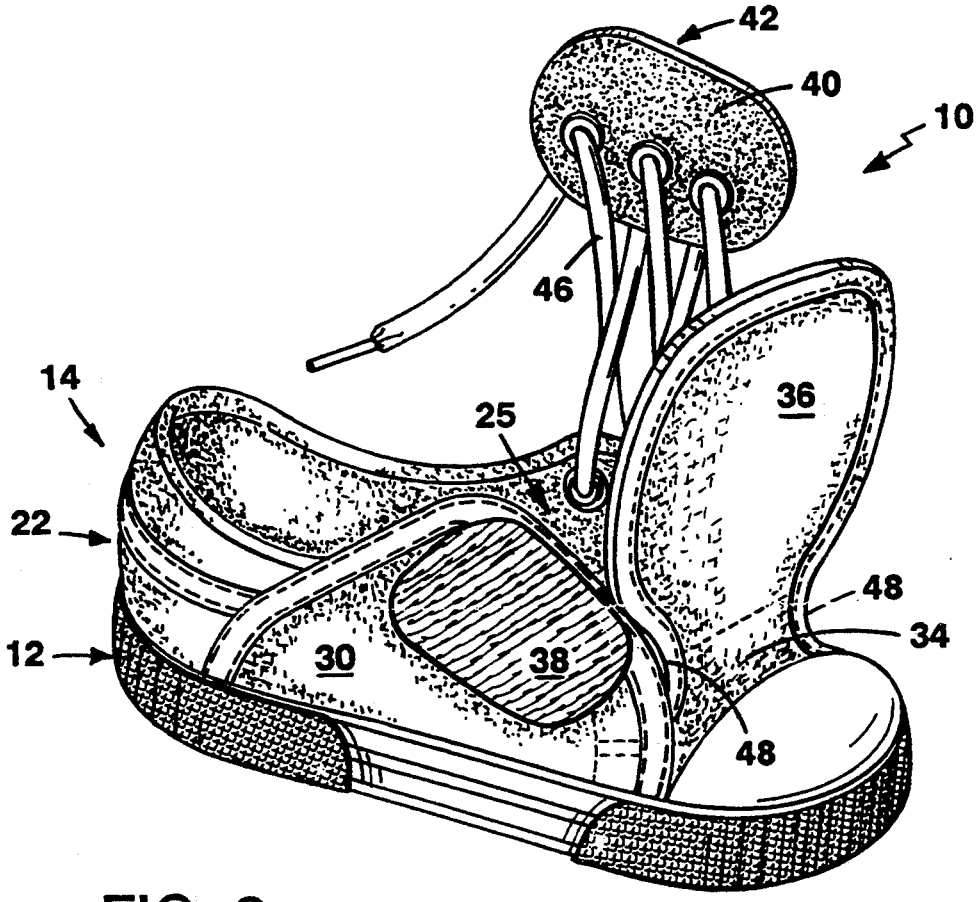
FIG. 2 is a perspective view of the shoe shown in FIG. 1, in an unfastened condition.

As shown most clearly in FIG. 2, side quarter 30 includes a fastener element 38. As shown, the preferred fastener assembly is a hook-and-loop type fastener, e.g., of the type available under the trademark VELCRO. Other conventional fasteners can be used, however, including, e.g., snaps or zippers. A cooperating fastener element 40 is disposed on the underside of fastening portion 42, the upper side of which is preferably made of the same type of material as side quarters 30 or 32, but may be made of an different decorative material for contrast. As shown, fastening portion 42 preferably includes a plurality of eyelets 44 which correspond to eyelets 46 on side quarter 32. A shoelace 46 is threaded through the corresponding eyelets 44, 46 in any conventional manner, to attach fastening portion 42 to side quarter 32, with which it is associated.

As shown in FIG. 1, when fastening portion 40 engages fastening portion 38, the shoe is securely fastened, and resembles a conventional lace-up shoe. Tongue 36 is positioned under shoelace 46, across forefoot opening 25, against the forefoot of the wearer. If desired, shoelace 46 can be used in a conventional manner to adjust the size of the shoe, or to teach a child how to tie the shoe.

As shown in FIG. 2, when the shoe is to be put on or removed, fastening portion 40 can be moved entirely out of forefoot opening 25, providing the large combined area of openings 23 and 25 for insertion or removal of the wearer's foot. Fastening portion 40 advantageously stays in this position without being held, due to the flexibility/softness imparted by the shoelace 46.

Figure 2A:
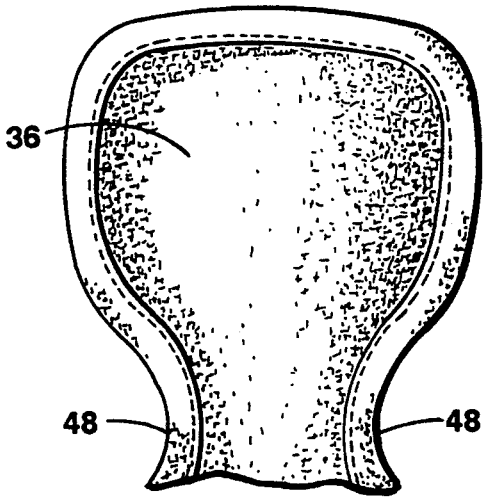
FIG. 2*a* is a plan view of the tongue portion of the shoe shown in FIG. 2.
Figure 3:
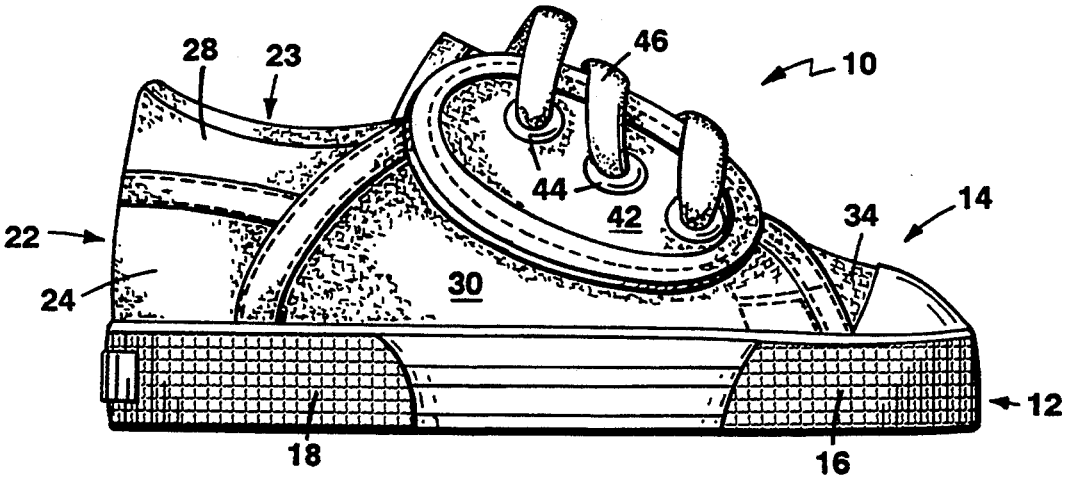
FIG. 3 is a left (inner) side view of the shoe shown in FIG. 1.
Figure 4:
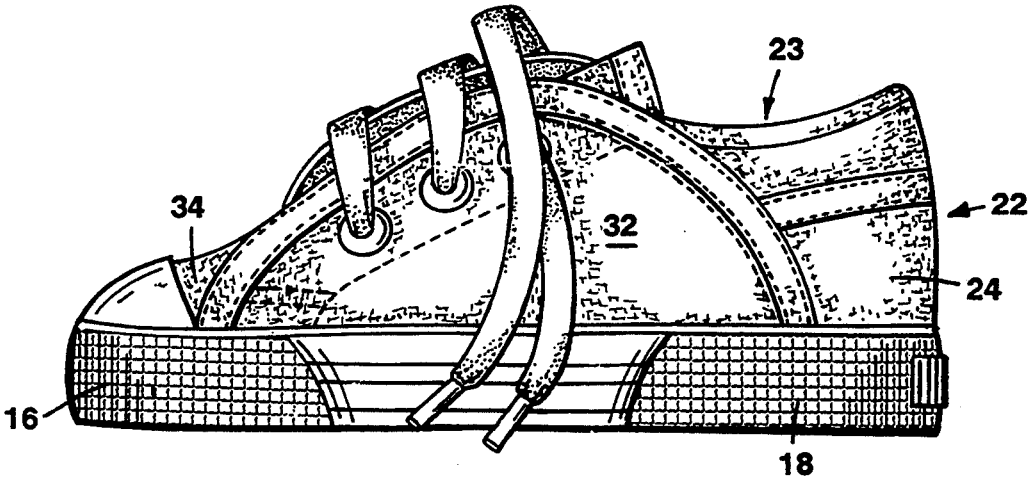
FIG. 4 is a right (outer) side view of the shoe shown in FIG. 1.

Tongue 36 can also be moved out of the way of the wearer's foot (out of forefoot opening 25), into the forward position shown in FIG. 2. Tongue 36 also stays in position without being held, due to notches 48, defined by the tongue at either side of the tongue, in the region where the tongue meets toe portion 34. The front edges 50*a*, 50*b* of side quarters 30, 32 are urged into notches 48, due to the tendency of the side quarters to incline inwardly, thereby retaining the tongue in its forward position. The preferred shape of the tongue is shown in detail in FIG. 2*a*. While U-shaped notches, as shown, are preferred, the notches could have any suitable shape which would engage edges 50*a*, 50*b* to hold the tongue in its forward position.

Shoe 10 may be assembled by any conventional method, as is well known in the art.

Other embodiments are within the claims. For example, the shoe need not be a "sneaker", as shown, but may be any type of shoe, e.g., a casual shoe or running shoe. The improved tongue and fastener assembly of the invention could be utilized with any type of upper and sole combination. The shoe may be provided in any size, i.e., in adult as well as children's sizes. While fastening portion 42 is separate from side quarter 32 in the illustrated embodiment, if desired, fastening portion 42 can have a continuous flap of material extending from side quarter 32. While in the preferred embodiment, the improved tongue and fastening features of the invention are used together, they could be used independently. For example, the preferred tongue of the

What is claimed is:

1. A shoe comprising a sole; and an upper mounted on said sole, said upper having a vamp comprising a pair of side quarters which define a foot receiving opening therebetween, a fastener assembly which, in a first position, extends across the opening to join the two side quarters, and which is moveable to a second position, in which it is clear of said foot-receiving opening, and which is hinged so that, when moved to the second position, it remains in that position until it is moved back to the first position, a toe portion which defines the front of said opening said toe portion being sized to, in combination with a portion of said sole, define a toe box shaped to receive a wearer's toes, and a substantially hourglass-shaped tongue, extending from the toe portion, which is moveable between a first, normal position, in which said tongue extends across the opening, between said side quarters, and a second position, in which said tongue is clear of the opening, said tongue having a pair of notches, one notch at each side edge of said tongue, wherein said tongue is held in said second position by the notches being engaged with a front edge of the side quarters until it is moved back to said normal position.

2. The shoe of claim 1 wherein said notches are substantially U-shaped.

3. The shoe of claim 1 wherein said fastener assembly is a hook-and-loop fastener.

4. A shoe comprising a sole; and an upper mounted on said sole, said upper having a vamp comprising a first side quarter and an opposed second side quarter which together define a foot-receiving opening therebetween, a fastener assembly which extends across the opening to join the opposed first and second side quarters, comprising a first fastening portion associated with said first side quarter, and a second fastening portion associated with said second side quarter and positioned to engage said first fastening portion, said second fastening portion being moveable between a first position in which said second fastening portion extends across the opening defined by the said opposed side quarters to engage said first fastening portion, and a second position in which said second fastening portion is clear of said opening, and said second fastening portion being adapted to remain in said second position until affirmatively moved toward said first position, a toe portion defining a front of said opening said toe portion being sized to, in combination with a portion of said sole, define a toe box shaped to receive a wearer's toes, and a substantially hourglass-shaped tongue extending from said toe portion, said tongue being moveable between a first, normal tongue position extending across the opening, between the opposed said side quarters, and a second tongue position clear of the opening, said tongue having a pair of notches, one notch at each side edge of said tongue, wherein said tongue is held in said second position by the notches being engaged with a front edge of the side quarters until affirmatively moved back toward said first, normal tongue position.

5. The shoe of claim 4 wherein said notches are substantially U-shaped.

6. The shoe of claim 4 wherein said second fastening portion includes a first set of eyelets disposed for receiving a shoelace, said second side quarter includes a corresponding opposed second set of eyelets, and said second fastening portion is detachably mounted on said first side quarter, with a shoelace threaded through the opposed first and second sets of eyelets.

7. The shoe of claim 4 wherein said fastener assembly comprises a hook-and-loop fastener.

8. A method of placing a shoe on a wearer's foot comprising the steps of (a) providing a shoe comprising a sole; and an upper mounted on said sole, said upper having a vamp comprising a pair of side quarters which define a footreceiving opening therebetween, a fastener assembly which, in a first position, extends across the opening to join the two side quarters, and which is moveable to a second position, in which it is clear of said foot-receiving opening, and which is hinged so that, when moved to the second position, it remains in that position until it is moved back to the first position, a toe portion which defines the front of said opening, and a substantially hourglass-shaped tongue, extending from the toe portion, which is moveable between a first, normal position, in which said tongue extends across the opening, between said side quarters, and a second position, in which said tongue is clear of the opening, said tongue having a pair of notches, one notch at each side edge of said tongue, wherein said tongue is held in said second position by the notches being engaged with a front edge of the side quarters until it is moved back to said normal position;

(b) moving the fastening means to its second position;

(c) grasping the tongue and moving the tongue from the first to the second position, so that the tongue is clear of the foot-receiving opening;

(d) letting go of the tongue and maneuvering the wearer's foot into the foot-receiving opening;

(e) returning the tongue to its first, normal position covering the wearer's foot; and (f) moving the fastening means to its second position to fasten the shoe.

* * * * *

UNITED STATES PATENT AND TRADEMARK OFFICE

CERTIFICATE OF CORRECTION

PATENT NO. : 5,357,691

DATED : October 25, 1994

INVENTOR(S) : Paula Hyde and Jennifer May

It is certified that error appears in the above-identified patent and that said Letters Patent is hereby corrected as shown below:

Col. 2, line 37, after "1-4", insert a period.

Col. 2, line 37, after "sneaker" insert --, i.e.,--.

Col. 3, line 45, after "the" (second occurence) insert --invention could be used with conventional hook-and-loop strap closures, which would be held out of the way of the forefoot opening, or, conversely, the preferred fastener assembly of the invention could be used with a conventional tongue, which would be held out of the way.--

Col. 3, claim 1, line 51, "footreceiving" should be --foot-receiving--.

Col. 5, claim 8, lines 3-4, "footreceiving" should be --foot-receiving--.

Signed and Sealed this

Twentieth Day of August, 1996

Bruce Lehman

*Attest:*

BRUCE LEHMAN

*Attesting Officer*

*Commissioner of Patents and Trademarks*